US010215402B2

(12) United States Patent
Ben-Mansour et al.

(10) Patent No.: US 10,215,402 B2
(45) Date of Patent: Feb. 26, 2019

(54) GAS-ASSISTED LIGUID FUEL OXYGEN REACTOR

(71) Applicants: Saudi Arabian Oil Company, Dhahran (SA); King Fahd University of Petroleum and Minerals, Dhahran (SA)

(72) Inventors: Rached Ben-Mansour, Dhahran (SA); Mohamed A. Habib, Dhahran (SA); Aqil Jamal, Dhahran (SA)

(73) Assignees: KING FAHD UNIVERSITY OF PETROLEUM AND MINERALS, Dhahran (SA); SAUDI ARABIAN OIL COMPANY, Dhahran (SA)

( * ) Notice: Subject to any disclaimer, the term of this patent is extended or adjusted under 35 U.S.C. 154(b) by 385 days.

(21) Appl. No.: 15/087,300

(22) Filed: Mar. 31, 2016

(65) Prior Publication Data

US 2017/0284661 A1 Oct. 5, 2017

(51) Int. Cl.
*F23D 5/00* (2006.01)
*F23D 5/12* (2006.01)
(Continued)

(52) U.S. Cl.
CPC ..... *F23D 5/00* (2013.01); *F23D 5/12* (2013.01); *F23D 11/10* (2013.01); *F23D 11/404* (2013.01);
(Continued)

(58) Field of Classification Search
CPC . F23D 5/00; F23D 5/12; F23D 11/404; F23D 11/44; F23D 23/00; F23D 11/10; F23D 2212/10; F23N 3/00
See application file for complete search history.

(56) References Cited

U.S. PATENT DOCUMENTS 5,562,754 A 10/1996 Kang et al.
5,702,999 A 12/1997 Mazanee et al.
(Continued)

OTHER PUBLICATIONS

Zeng, Y., Lin, Y. S. and Swartz, S. L., "Perovskite-type ceramic membrane: synthesis, oxygen permeation and membrane reactor performance for oxidative coupling of methane", Journal of Membrane Science, 150(1), Jul. 5, 1998.
(Continued)

*Primary Examiner* — Alfred Basichas
(74) *Attorney, Agent, or Firm* — Leason Ellis LLP

(57) ABSTRACT

The present disclosure is directed to systems and methods for low-$CO_2$ emission combustion of liquid fuel with a gas-assisted liquid fuel oxygen reactor. The system comprises an atomizer that sprays fuel and $CO_2$ into an evaporation zone, where the fuel and $CO_2$ is heated into a vaporized form. The system comprises a reaction zone that receives the vaporized fuel and $CO_2$. The system includes an air vessel having an air stream, and a heating vessel adjacent to the air vessel that transfers heat to the air vessel. The system comprises an ion transport membrane in flow communication with the air vessel and reaction zone. The ion transport membrane receives $O_2$ permeating from the air stream and transfers the $O_2$ into the reaction zone resulting in combustion of fuel. The combustion produces heat and creates $CO_2$ exhaust gases that are recirculated in the system limiting emission of $CO_2$.

10 Claims, 7 Drawing Sheets

(51) Int. Cl.

| | |
|---|---|
| ***F23N 3/00*** | (2006.01) |
| ***F23D 11/10*** | (2006.01) |
| ***F23D 11/40*** | (2006.01) |
| ***F23D 11/44*** | (2006.01) |
| ***F23D 23/00*** | (2006.01) |

(52) U.S. Cl.

CPC ..... *F23D 11/44* (2013.01); *F23D 23/00* (2013.01); *F23N 3/00* (2013.01); *F23D 2212/10* (2013.01)

(56) References Cited

U.S. PATENT DOCUMENTS

| | | | |
|---|---|---|---|
| 5,820,655 | A | 10/1998 | Gottzmann et al. |
| 6,153,163 | A | 11/2000 | Prasad et al. |
| 6,293,084 | B1 | 9/2001 | Drnevich et al. |
| 6,360,524 | B1 | 3/2002 | Drnevich et al. |
| 6,375,913 | B1 | 4/2002 | Alhaugh et al. |
| 6,394,043 | B1 | 5/2002 | Bool, III et al. |
| 6,499,300 | B2 | 12/2002 | Griffin |
| 6,551,386 | B2 | 4/2003 | Weiler |
| 6,562,104 | B2 | 5/2003 | Bool, III et al. |
| 6,565,632 | B1 | 5/2003 | van Hassel et al. |
| 7,125,528 | B2 | 10/2006 | Besecker et al. |
| 7,160,357 | B2 | 1/2007 | Gotzmann |
| 7,556,675 | B2 | 7/2009 | Carolan et al. |
| 8,820,312 | B2 | 9/2014 | Habib et al. |
| 2014/0174329 | A1 | 6/2014 | Nemitallah et al. |
| 2015/0176487 | A1 | 6/2015 | Habib et al. |
| 2015/0267611 | A1 | 9/2015 | Nemitallah et al. |

OTHER PUBLICATIONS

Kvamsdal, H. K., Jordal, K. and Bolland, O., "A quantitative comparison of gas turbine cycles with CO2 capture", Energy, 32(1), Jan. 2007.

Elia P. Demetri VanEric Stein, Edhi Juwono, "Improving IGCC economics through ITM oxygen integration", In 18th International Pittsburgh Coal Conference, 2001.

Coroneo, M. et al "CFD Modelling of inorganic membranes modules for gas mixture separation"; Chem Engg Science, 64 (Mar. 2009) 1085-1094.

F. U. Guide, "Fluent 6.3 Getting Started Guide," Fluent Inc. Lebanon, NH, Sep. 2006.

Kusaba, H. et al., "Surface effect on oxygen permeation through dense membrane of mixed-conductive LSCF perovskite-type oxide," Solid State Ionics Solid State Ionics 15: Proceedings of the 15th International Conference on Solid State Ionics, Part II, vol. 177, pp. 2249-2253, Oct. 31, 2006.

S. J. Xu and W. J. Thomson, "Oxygen permeation rates through ion-conducting perovskite membranes," Chemical Engineering Science, vol. 54, pp. 3839-3850, Nov. 9, 1998.

W. Zhong, et al., "Determination of flow rate characteristics of porous media using charge method, Flow Measurement and Instrumentation", vol. 22, pp. 201-207, Feb. 27, 2011.

Behrouzifar et al. Experimental Investigation and Mathematical Modeling of Oxygen Permeation Through Dense $Ba_{0.5}Sr_{0.5}Co_{0.8}Fe_{0.2}O_{3-\delta}$(BSCF) Perovskite-type Ceramic Membranes. Ceramics International: 38 (Mar. 3, 2012); 4797-4811.

Coroneo, M. et al "CFD-simulation of mass transfer effects in gas and vapour permeation modules"; Elsevier, Desalination 146 (Apr. 3, 2002) 237-241.

GAS-ASSISTED LIGUID FUEL OXYGEN REACTOR

TECHNICAL FIELD

The present disclosure relates to methods and systems for combustion and carbon capture, more particularly, methods and systems involving oxygen transport reactors for the combustion of liquid fuels and the efficient capture of carbon dioxide.

BACKGROUND

Fossil fuels remain the main source of energy, particularly in the transportation industry. However, due to the large $CO_2$ production associated with fossil fuel use, it is also a major contributor to global warming.

Among these fossil fuels, liquid fuels are being widely used in the transportation industry because of their safety and high calorific values. Liquid fuels still produce large amounts of $CO_2$, and in order to capture the $CO_2$, different techniques are currently available including pre-combustion, post-combustion, and oxyfuel combustion technologies. Currently, oxyfuel combustion technologies are considered some of the most promising carbon capture technologies. For oxyfuel combustion, oxygen is burnt in a combustion chamber with fuel and the combustion products include only $CO_2$ and $H_2O$. The $CO_2$ and $H_2O$ can then be separated via a condensation process leaving behind only $CO_2$ that can be recycled or stored through the sequestration process. This process requires pure oxygen ($O_2$), obtained via cryogenic distillation for example. However the cryogenic distillation process of separation of $O_2$ from the air is very costly.

One of the alternatives for the separation of $O_2$ from air that may be more cost effective is the use of Ion Transport Membranes (ITMs), which can reduce the penalty of air separation units in oxy-combustion. These ITMs have the capability of separating the $O_2$ from air at elevated temperatures, typically above 700° C. Oxygen permeation through these membranes is a function of partial pressure of oxygen across the membranes, membrane thickness, and the temperature at which these membranes are operating. When the combustion is done simultaneously with the $O_2$ separation via ITMs, the unit is generally referred to as an oxygen transport reactor.

One of the main challenges of oxygen transport reactors is the low fluxes that are obtained by the membranes. Under these low fluxes the heat rates generated in a given volume is relatively low.

As such, there is a need for an oxygen transport reactor that addresses the deficiencies of the prior art, namely the low fluxes obtained by the membranes and consequently the issue of heating up the membranes economically.

SUMMARY

According to a first aspect, a gas-assisted liquid fuel oxygen reactor system is provided. The system comprises an atomizer (e.g., $CO_2$-assisted atomizer) having an inlet adapted to receive a liquid fuel and an outlet adapted to spray atomized fuel and $CO_2$. The system further comprises an evaporation zone having an inlet adapted to receive the atomized liquid fuel and $CO_2$ and having an outer wall. In one aspect, the outer wall of the evaporation zone is lined with (thermal) conductive plates such that the evaporation zone is adapted to heat the atomized fuel and $CO_2$ into a vaporized form. The system further comprises a reaction zone co-axially aligned with and in flow communication with the evaporation zone. The reaction zone is adapted to receive a flow of the vaporized fuel and $CO_2$ from the evaporation zone.

According to one aspect, the system further comprises an ion transport membrane that is coaxially aligned with the evaporation zone and defines the reaction zone. According to one aspect, the system further comprises an air vessel defined by structure that is disposed about the ion transport membrane and defines a first space between an outer surface of the ion transport membrane and an inner surface of the air vessel structure. In an aspect, the air vessel receives an air stream that flows through the air vessel in the opposite direction of the flow of the vaporized fuel and $CO_2$ in the reaction zone. In one aspect, the air vessel structure can be formed of a thermally conductive material.

According to one aspect, the system can further comprise a heating vessel defined by a structure that is disposed about the air vessel structure and defines a second space between an outer surface of the air vessel structure and an inner surface of the heating vessel structure. In one aspect, the heating vessel receives a heated air and gaseous fuel stream such that heat is transferred from the air and gaseous fuel stream to the first space.

According to one aspect, the ion transport membrane is adapted to provide $O_2$ permeating from the air stream and transfer the $O_2$ into the reaction zone resulting in an $O_2$-depleted air stream in the first space of the air vessel structure. The reaction zone is further adapted to combust the vaporized fuel and $CO_2$ in the presence of the $O_2$ to produce heat and create exhaust gases that are recirculated in the system. In a further aspect, the recirculation of the exhaust gases provides energy to the system to maintain an at least substantially constant temperature at the ion transport membrane. According to one aspect, the temperature at the ion transport membrane is maintained between 700° C. and 900° C.

According to one aspect, the system has a cylindrical shape, with the ion transport membrane, the air vessel structure, and the heating vessel structure being concentric to one another, and wherein the reaction zone is located internally to the ion transport membrane.

According to another aspect, the ion transport membrane comprises first and second planar membranes with the reaction zone disposed there between. According to a further aspect, the air vessel comprises first and second planar plates with the ion transport membrane disposed there between. In a further aspect, the evaporation zone, the ion transport membrane, the air vessel, and the heating vessel define a first reactor unit, and the system can further include a second reactor unit having an identical construction as the first reactor unit, where the first and second reactor units are in a stacked orientation.

According to another aspect, the system can further comprise a fuel filter situated between the evaporation zone and the reaction zone. The fuel filter is adapted to remove unwanted contaminants from the vaporized fuel and $CO_2$ prior to entry of the vaporized fuel and $CO_2$ into the reaction zone. According to another aspect, the system can also comprise a bluff body located within the evaporation zone and adapted to assist in the evaporation of the fuel.

According to another aspect, the system can comprise a heat exchanger located upstream of the $CO_2$-assisted atomizer. The heat exchanger is adapted to receive the $O_2$-depleted air stream from the air vessel and the liquid fuel, and adapted to transfer heat from the $O_2$-depleted air stream to the liquid fuel prior to the liquid fuel being received in the $CO_2$-assisted atomizer.

In another aspect, the system can comprise a series of tubes comprised of ion transport membranes situated within the reaction zone (rather than ion transport membrane(s) on the exterior of the reaction zone). The series of ion transport membrane tubes are oriented perpendicularly to the flow of the vaporized fuel and $CO_2$ in the reaction zone. The ion transport membrane tubes are also adapted to receive an air stream and to allow permeation of $O_2$ from the air stream out through the ion transport membranes and into the reaction zone, thereby resulting in an $O_2$-depleted air stream in the tubes and a combustion reaction in the reaction zone and external to the ion transport membranes.

According to another aspect, a method for low-$CO_2$ emission combustion of a liquid fuel in a gas-assisted liquid fuel oxygen reactor is provided. The method comprises injecting a liquid fuel into an evaporation zone, wherein the fuel is injected via an atomizer (e.g., $CO_2$-assisted atomizer) adapted to spray the liquid fuel and $CO_2$ into the evaporation zone. The method further comprises vaporizing the liquid fuel and $CO_2$ in the evaporation zone, resulting in a mixture of evaporated (vaporized) fuel and $CO_2$, and the mixture of evaporated fuel and $CO_2$ then flows into a reaction zone.

According to another aspect, a flow of air is supplied into an air vessel, wherein the air vessel and reaction zone are separated by an ion transport membrane, and wherein $O_2$ permeates from the flow of air through the ion transport membrane and into the reaction zone. The permeation of $O_2$ into the reaction zone results in an $O_2$-depleted air stream in the air vessel.

According to another aspect, a hot air and gaseous fuel stream is delivered into a heating vessel adjacent to the air vessel, wherein heat from the hot air and gaseous fuel stream is transferred to the air vessel. According to a further aspect, the heat can be transferred via (thermal) conductive plates separating the heating vessel and the air vessel. According to another aspect, the evaporated fuel and $CO_2$ combust in the presence of the $O_2$ in the reaction zone to produce heat and create an exhaust gas stream.

According to another aspect, the method further comprises heating the liquid fuel prior to injection of the liquid fuel into the evaporation zone. According to a further aspect, the liquid fuel is heated via a heat exchanger. According to a further aspect, the step of heating the liquid fuel prior to injection into the evaporation zone comprises recirculating the $O_2$-depleted air stream to a heat exchanger upstream of the reaction zone wherein the recirculated $O_2$-depleted air stream transfers heat to the liquid fuel.

According to another aspect, the method further comprises recirculating the exhaust gas stream to transfer heat to the air vessel. In certain embodiments, the heat is transferred to the air vessel via one or more (thermal) conductive plates lining the air vessel.

According to another aspect, the step of vaporizing the liquid fuel comprises transferring heat from the hot air and gaseous fuel stream to the evaporation zone via (thermal) conductive plates lining an outer wall of the evaporation zone.

According to another aspect, the method further comprises the step of filtering the mixture of evaporated fuel and $CO_2$ prior to flowing the mixture into the reaction zone. According to a further aspect, the evaporated fuel and $CO_2$ is filtered via a fuel filter.

According to another aspect of the method, the air vessel and the ion transport membrane are located within the reaction zone and wherein the flow of the mixture of evaporated fuel and $CO_2$ into the reaction zone is perpendicular to the ion transport membrane. According to a further aspect, the ion transport membrane is a tube surrounding the air vessel.

BRIEF DESCRIPTION OF THE DRAWING FIGURES

Further aspects of the present application will be more readily appreciated upon review of the detailed description of its various embodiments, described below, when taken in conjunction with the accompanying drawings, of which:

Figure 4B:
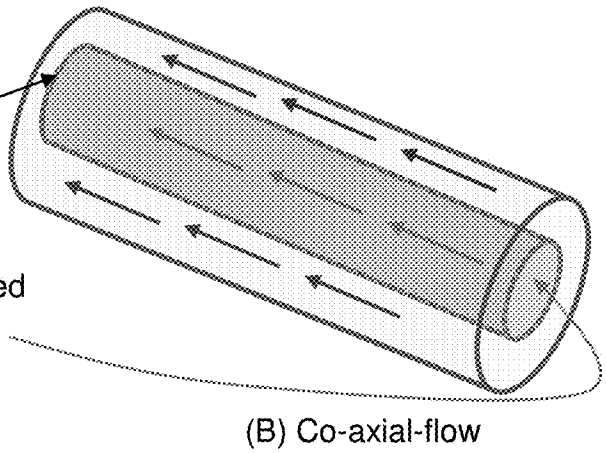
Figure 4A:
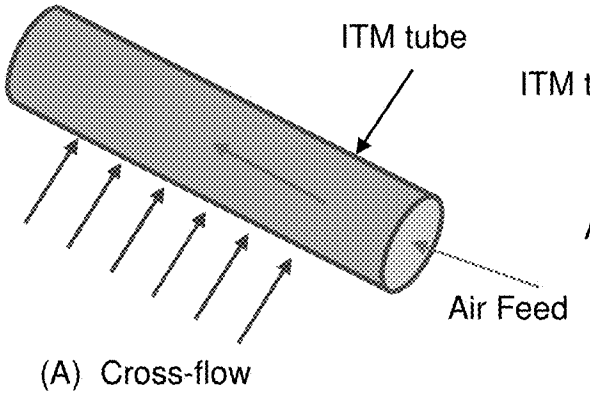
Figure 5:
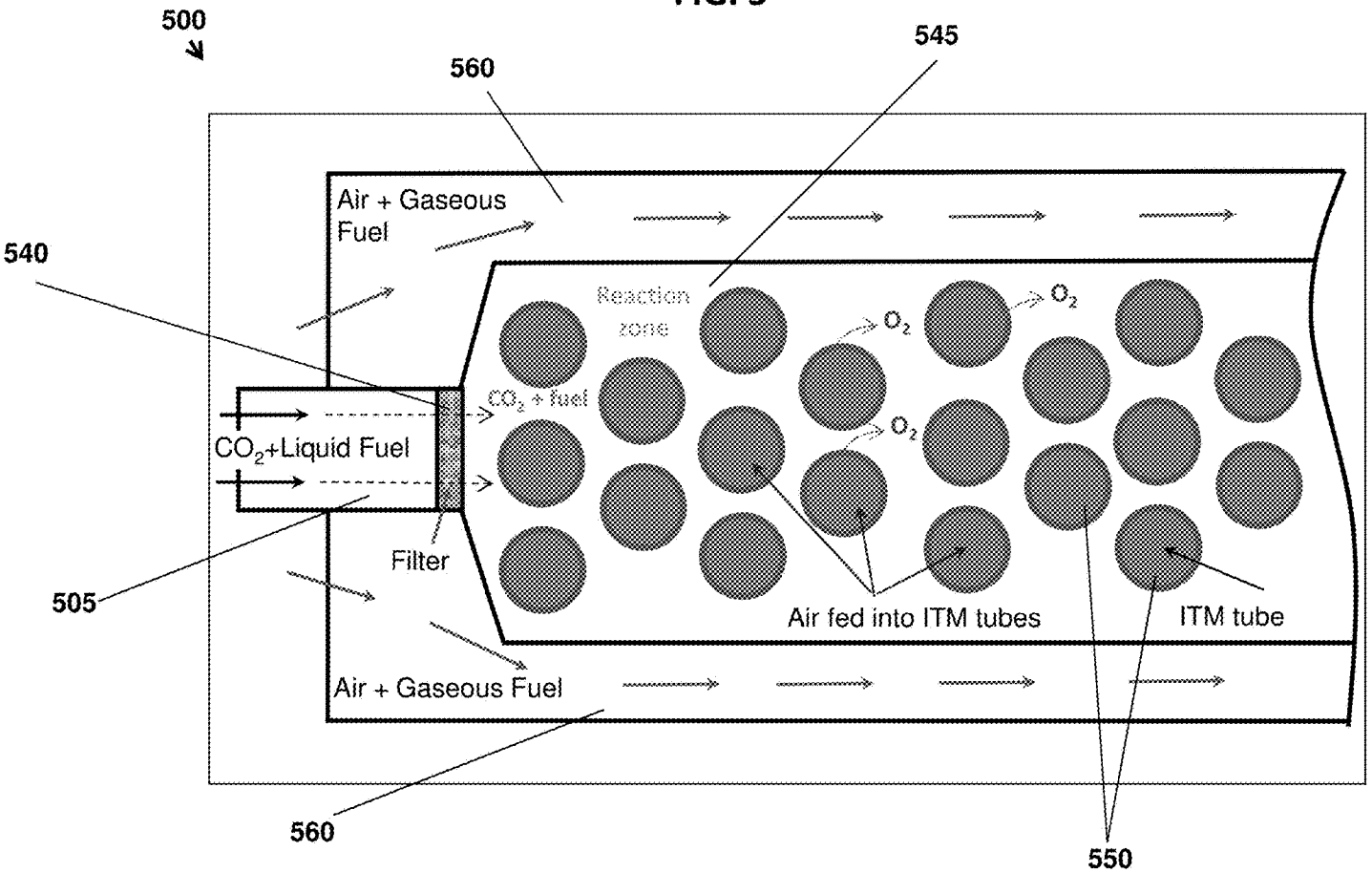
Figure 6:
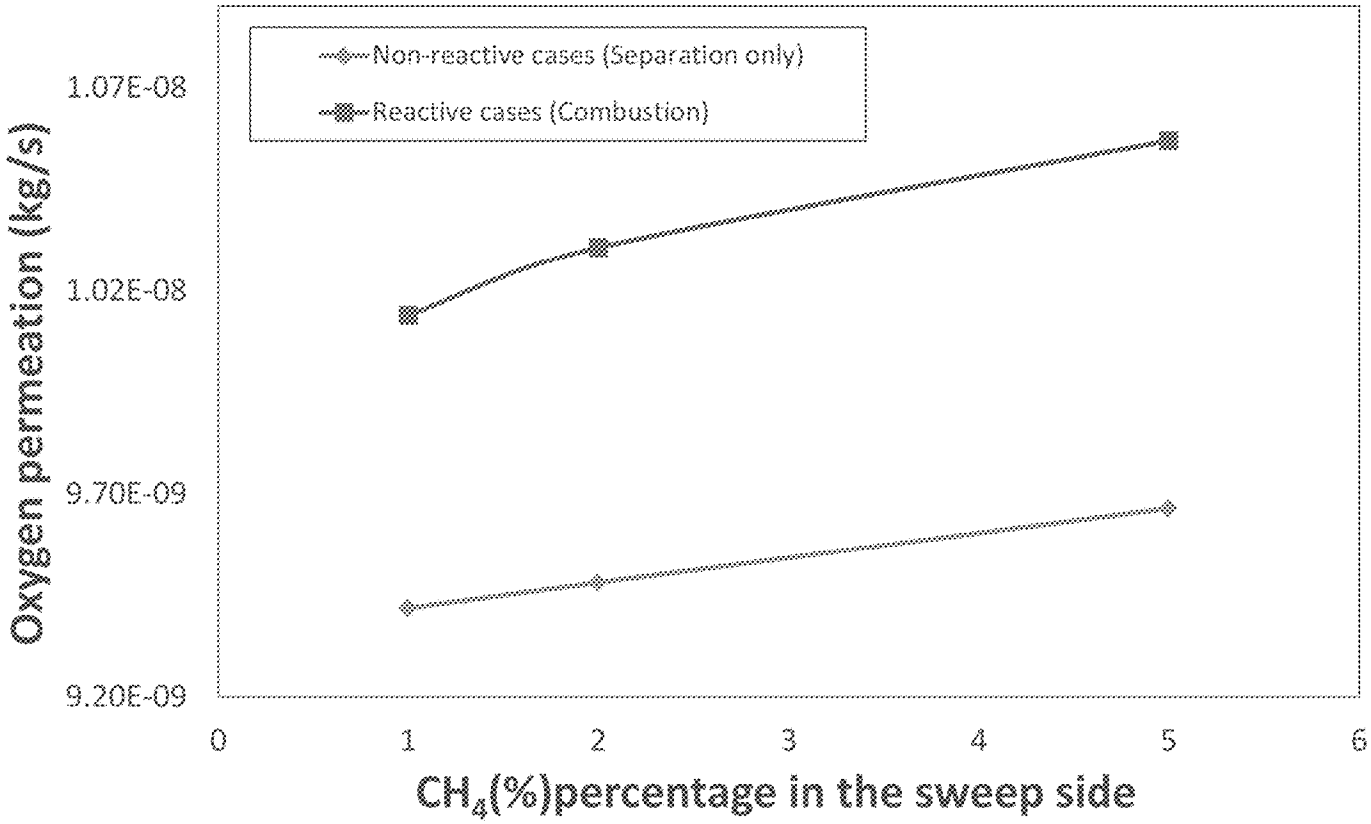
Figure 7:
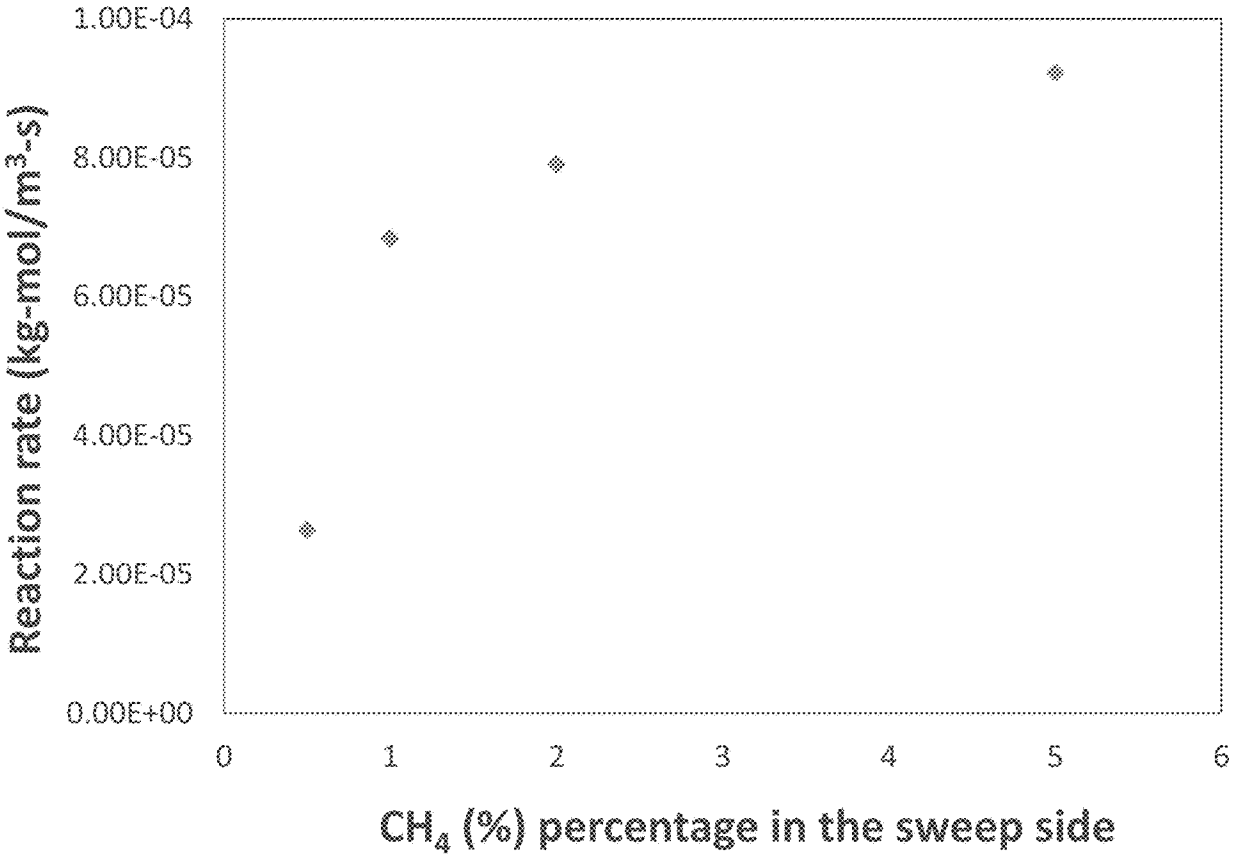

FIGS. 4A-B are schematic drawings comparing the operation of a cross-flow ion transport membrane (4A) with the operation of a co-axial flow ion transport membrane (4B) in accordance with one or more embodiments;

FIG. 5 is a side view of an embodiment of the gas-assisted liquid fuel oxygen reactor having cross-flow ion transport membranes in accordance with one or more embodiments;

FIG. 6 is a line graph showing the oxygen permeation rate through the ion transport membrane for non-reactive and reactive cases with increasing percentage of $CH_4$ in the sweep gas, in accordance with one or more embodiments; and FIG. 7 is a graph showing the reaction rates in the reaction zone with an increasing percentage of $CH_4$ in the sweep gas, in accordance with one or more embodiments.

DETAILED DESCRIPTION OF CERTAIN EMBODIMENTS

The present disclosure details systems and methods for a gas-assisted liquid fuel oxygen transport reactor. In particular, the present application discloses a low-carbon emission oxygen transport reactor for liquid fuel which utilizes gas combustion. In one or more embodiments, the present system comprises a gas-assisted (e.g., $CO_2$ gas) atomizer that provides an atomized spray of liquid fuel and gas into an evaporation zone. The atomized fuel and gas is heated in the evaporation zone and then permeates through a fuel filter into a reaction zone (oxygen transport reactor). A flow of air (air stream) is also fed into the system in a conduit (vessel) adjacent to the reaction zone. This air stream conduit and the reaction zone are separated by one or more ion transport membranes. Due to the conditions of the air stream conduit, the oxygen from the air stream permeates through the ion transport membrane and into the reaction zone. The combination of the atomized fuel and gas and the permeated oxygen in the reaction zone results in the combustion of the fuel and the production of heat.

In conventional methods, the ion transport membrane operates under low flux, and as such, the rate of heat generated by the reaction zone is relatively low. The system of the present application, however, utilizes the stream of atomized gas (e.g., $CO_2$) as a sweep gas to increase the fluxes of oxygen obtained in the reaction zone through the ion transport membrane. Further, the present system is a closed-loop control system in which the gas and air streams are recirculated throughout the system to maintain a constant temperature at the ion transport membrane. For instance, the gas combustion reactions in the reaction zone are used to heat the ion transport membrane(s) to the desired temperature, and the energy required for maintaining the temperature at the ion transport membrane is provided by the partial recirculation of the exhaust gases exiting the reaction zone. Similarly, after losing oxygen via the ion transport membrane, the now oxygen-depleted air stream (flow) can also be used to recirculate heat within the system by providing heat to the liquid fuel via a heat exchanger prior to its entry into the evaporation zone. Maintaining a constant temperature at the ion transport membrane avoids thermal stresses in the ion transport membrane, and thus results in improved membrane stability and thermal performance.

The systems and methods of the present application allow for efficient self-heating of the system, as well as storage of $CO_2$ from the exhaust gases, which significantly reduces $CO_2$ emissions. Further, because the combustion of the fuel is conducted with oxygen rather than air, the system does not result in the emission of $NO_N$.

The referenced systems and methods for a gas-assisted liquid fuel oxygen transport reactor are now described more fully with reference to the accompanying drawings, in which one or more illustrated embodiments and/or arrangements of the systems and methods are shown. The systems and methods are not limited in any way to the illustrated embodiments and/or arrangements as the illustrated embodiments and/or arrangements are merely exemplary of the systems and methods, which can be embodied in various forms as appreciated by one skilled in the art. Therefore, it is to be understood that any structural and functional details disclosed herein are not to be interpreted as limiting the systems and methods, but rather are provided as a representative embodiment and/or arrangement for teaching one skilled in the art one or more ways to implement the systems and methods.

Figure 1:
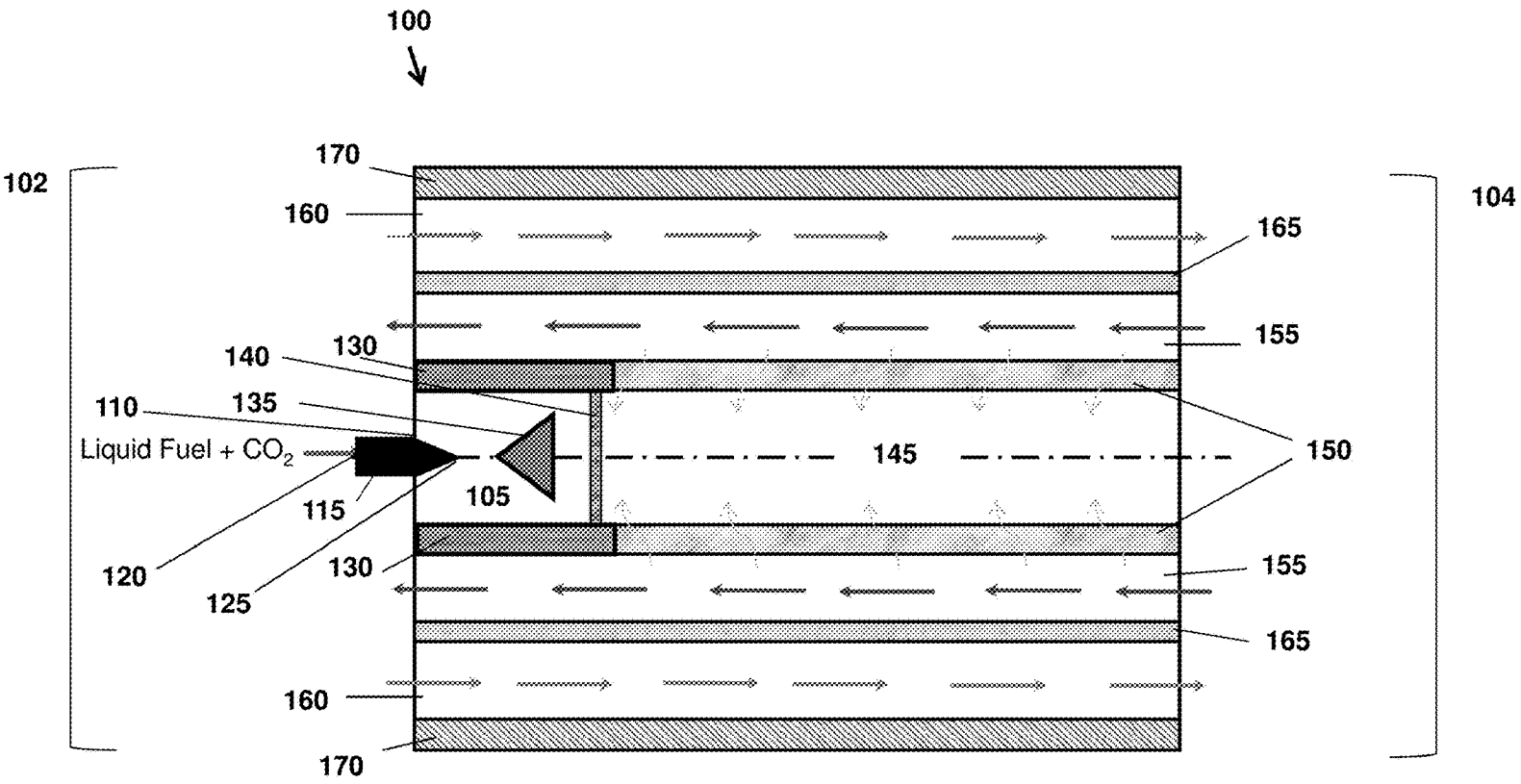
FIG. 1 is a cross-sectional view of the gas-assisted liquid fuel oxygen reactor in a cylindrical configuration in accordance with one or more embodiments.

FIG. 1 illustrates a cross-sectional view of an exemplary system 100 for a gas-assisted liquid fuel oxygen transport reactor. In this embodiment, the system 100 has a cylindrical configuration, such as a cylindrical pipe. In at least one embodiment, the system can have a planar configuration having horizontal fuel injection slots. As described herein, when the system 100 has a cylindrical shape, the system is made up of a series of concentric zones/regions. The system 100 can generally be thought to include a first end 102 and an opposing second end 104.

The cylindrical system 100 includes an evaporation zone 105. The evaporation zone includes an inlet 110 for receiving a fuel atomizer 115. Liquid fuel is injected into the evaporation zone 105 via the fuel atomizer 115. The liquid fuel can comprise one or more compounds including but not limited to methane ($CH_4$), but can also include gaseous fuels and light liquid fuels. In one or more embodiments, the fuel atomizer 115 is gas-assisted (e.g., $CO_2$-assisted). In an alternative embodiment, the fuel atomizer 115 can be a liquid fuel pressure atomizer. The fuel atomizer 115 can include an inlet 120 for receiving the liquid fuel and an outlet 125 adapted to spray liquid droplets of the atomized fuel and gas (e.g., $CO_2$) into the evaporation zone 105. The fuel atomizer 115 thus defines one end of the evaporation zone 105. The evaporation zone 105 further includes an outer wall 130 which can have an annular shape as shown. In one or more embodiments, the outer wall 130 can comprise one or more (thermal) conductive plates, which can be used to heat the atomized (i.e., liquid droplet) fuel and gas into a vaporized form as will be explained in greater detail below. In at least one embodiment, the evaporation zone 105 can further comprise a bluff body 135. The bluff body 135 can be used in the evaporation zone to assist in completion of the fuel evaporation and to stabilize the flame. The flame is located in the reaction zone 145. The bluff body 135 is located downstream of the atomizer 115.

With continued reference to FIG. 1, after evaporation of the fuel and gas (e.g., $CO_2$), the vaporized fuel and gas flow across a fuel filter 140 and into a reaction zone (oxygen transport reactor) 145. In particular, the flow of the $CO_2$ from the atomizer acts as a sweep gas pushing the atomized fuel through the fuel filter 140 and into the reaction zone 145. The fuel filter 140 ensures the removal of unwanted contaminants from the vaporized fuel and gas prior to entry into the reaction zone 145. The fuel filter 140 extends across (transverses) the evaporation zone 105 and is thus positioned such that the vaporized fuel and gas from the atomizer flows directly into and through the fuel filter 140. In one or more embodiments and as shown in FIG. 1, the reaction zone 145 is coaxially aligned with the evaporation zone 105 and located downstream thereof. Further, in the embodiment shown in FIG. 1, the evaporation zone 105 and reaction zone 145 are located in the innermost area (the core) of the cylindrical configuration (e.g., pipe).

As shown in FIG. 1, in one or more embodiments, the reaction zone 145 is surrounded by one or more ion transport membranes (ITMs) 150. In one or more implementations, the ITMs 150 are made of ceramic materials. In the illustrated embodiment, the ITM 150 has an annular shape with the reaction zone 145 being internal thereto. In at least one embodiment, such as when the system has a planar configuration, the ITM 150 can comprise a first and a second planar membrane surface, where the reaction zone 145 is disposed between the two planar membrane surfaces.

Exemplary ITM materials and additional properties of the ITM are disclosed in published paper by Behrouzifar et al. (Experimental Investigation and Mathematical Modeling of Oxygen Permeation Through Dense $Ba_{0.5}Sr_{0.5}Co_{0.8}Fe_{0.2}O_{3-\delta}$ (BSCF) Perovskite-type Ceramic Membranes. *Ceramics International:* 38 (2012); 4797-4811), which is herein incorporated by reference in its entirety. As discussed in the published paper by Behrouzifar et al., it should be appreciated that membrane thickness and temperature can affect oxygen flux across the ITMs. In particular, oxygen flux across the ITM generally increases with increased temperatures around the membrane, as well as with thinner membranes.

Surrounding the one or more ITMs is a first conduit 155 (air vessel). The first conduit 155 comprises an inlet (not shown) for an air stream. As with other components and features of the system 100, the first conduit 155 can have an annular shape and be concentric with the evaporation and reaction zones. As described below, the first conduit 155 is defined by ITMs 150 (and in part outer wall 130) and by an outer wall structure described below. The mixture of evaporated fuel and sweep gas in the reaction zone 145 induces oxygen from the air stream flowing in the first conduit 155 to transfer across the ITMs 150 into the reaction zone 145. In particular, the sweep gas (e.g., $CO_2$) in the reaction zone increases the fluxes of oxygen obtained through (across) the ITMs 150, thus inducing oxygen transport from the air stream (in conduit 145) across the ITMs 150.

Further, the air stream is fed into the system 100 in a counter-flow process in that the air stream flows in the opposite direction of the sweep gas/vaporized fuel. This counter flow process provides at least some of the energy required to heat the air stream and thus to maintain uniform temperature along the ITMs, which allows for improved membrane stability. The transport of oxygen into the reaction zone 145 results in the combustion of the fuel in the reaction zone 145, thereby resulting in the production of heat. In one or more embodiments, an increase in the percentage of fuel (e.g., $CH_4$) in the sweep gas results in increased oxygen permeation through the ITMs 150 as well as increased reaction rates in the reaction zone 145 (See FIGS. 6-7).

The combustion reaction also produces exhausts gases comprising $CO_2$ and water vapor. In one or more embodiments, at least part of the exhaust gases can be recirculated to provide partial heating to the air stream via (thermal) conductive plates 165, providing even greater oxygen flux across the ITMs 150. The air stream is heated by radiation from the combustion gases in the reaction zone 145. The heated air (oxygen depleted air) exiting 155 is to be circulated into a second conduit 160 to keep the high temperature of the air in 155. In at least one embodiment, combustion gases using air and fuel (burned outside of 100) are passed into the second conduit 160 as a source of heating to the air in 155.

Further, in one or more embodiments, the water vapor in the exhausted gases can be condensed leaving essentially only $CO_2$ in the exhaust gas stream, which can then be stored to reduce $CO_2$ emissions. Specifically, the gases leaving zone 155 can pass into a condenser (not shown) to condense the water vapor leaving $CO_2$ that can be compressed and stored.

As mentioned above, the air stream of conduit 155 is heated, which helps to maintain uniform temperature along the ITMs 150 allowing for improved membrane stability. In one or more embodiments, during operation, the ITMs are maintained at a temperature in the range of approximately 700° C. to approximately 900° C. The determination of the preferred temperature depends on an optimization of the high oxygen flux that can be achieved at high temperatures and the constraint of the thermal and mechanical stability of the ITM materials.

Unlike many conventional systems, the systems of the present application provide for combustion of fuel using oxygen rather than air, thus resulting in an exhaust stream that is free of nitrogen oxides ($NO_x$). Thus the systems of the present application are zero-$NO_x$ emission systems.

With continued reference to FIG. 1, after permeation of oxygen from the air stream through the ITMs 150, the now oxygen-depleted air stream in first conduit 155 can also be recirculated. In particular, the energy available in the oxygen-depleted air can be utilized to heat the fuel prior to entry into the evaporation chamber 105 via a heat exchanger, for example (see FIG. 3). As shown in FIG. 1, in at least one embodiment, the oxygen-depleted air of conduit 155 can also heat the fuel in the evaporation zone 105 via conductive plates in the outer wall 130.

As mentioned above, in at least one embodiment, the system 100 can also comprise a second conduit 160 (heating vessel) surrounding the first conduit 155, the second conduit 160 and first conduit 155 being separated by at least one (thermal) conductive wall/plate 165. The (thermal) conductive wall/plate 165 thus defines both the first conduit 155 and the second conduit 160. The (thermal) conductive wall/plate 165 can have an annular shape.

The second conduit 160 can comprises an inlet (not shown) for a stream of hot air/gaseous fuel stream. The hot air/gaseous fuel stream can provide heat to the air stream of the first conduit 155 via the (thermal) conductive walls/plates 165, thereby resulting in better oxygen flux from the air stream across the ITMs 150. In one or more embodiments, the cylindrical system 100 further comprises an outer wall 170 which serves as the outer barrier of the second conduit 160 and thus defines the second conduit 160.

It will also be understood that a fluid seal is formed between the outer wall 130 and the ITMs 150. As shown in FIG. 1, one end of the outer wall 130 abuts and seals against one end of the ITMs 150.

It will therefore be appreciated that, as shown in FIG. 1, the system 100 can include a series of flow paths that allow for a series of counter fluid flow. More specifically, in the illustrated embodiment, fluid flow in the evaporation and reaction zones and the second conduit 160 is in the same direction (parallel flow paths) and the fluid flow in the first conduit 155 is in the opposite direction (counter flow path). In addition, the various zones and flow paths are arranged in a concentric manner due to the fact that in the illustrated embodiment, the system 100 has a cylindrical shape defined at least in part by a series of concentric annular shaped zones/flow paths.

It will also be appreciated that the sizes of the different zones/flow paths can be varied and the present figures are merely exemplary and not limiting of the present invention. In addition, the direction of flow of each flow path is merely exemplary and not limiting in FIG. 1 in that flow shown as being from left to right can equally be from the right to the left.

It should also be understood that while FIG. 1 (system 100) is described as a cylindrical configuration, in at least one embodiment, the system can have a planar configuration such that the ITM 150 can comprise a first and a second planar membrane surface, where the reaction zone 145 is disposed between the two planar membrane surfaces. In this embodiment, the first conduit 155 (air vessel) can comprise first and second planar plates (conductive plates 165) with the first and second planar membrane surfaces disposed there between. Further, the second conduit 160 (heating vessel) can be defined by a planar outer wall 170 and the planar conductive plates 165.

Figure 2:
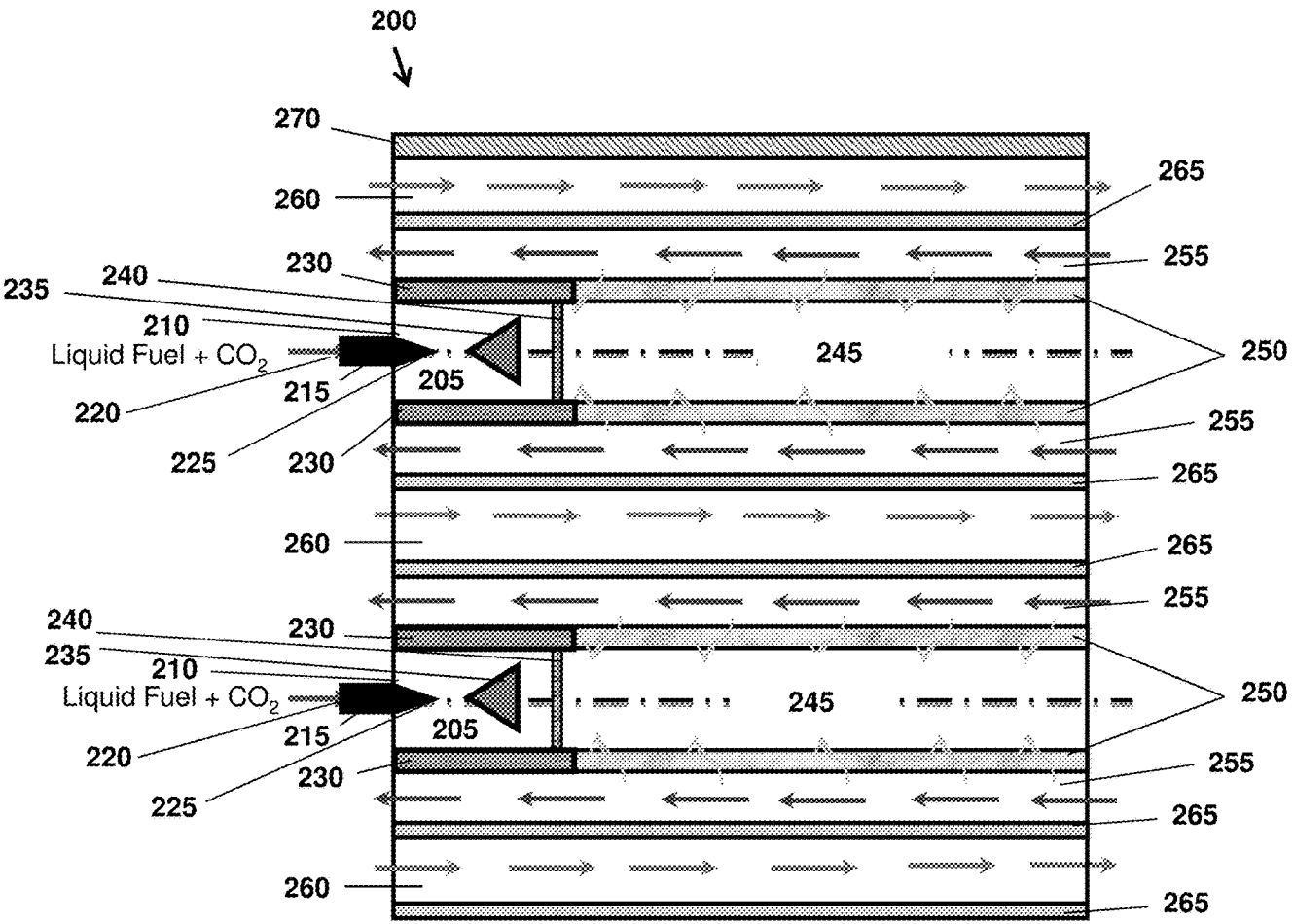
FIG. 2 is a cross-sectional view of an embodiment of the gas-assisted liquid fuel oxygen reactor in a periodic planar configuration having multiple reaction zones in accordance with one or more embodiments.

FIG. 2 shows a cross-sectional view of a second embodiment of the gas-assisted liquid fuel oxygen reactor system 200 in a periodic planar configuration having multiple reaction zones in accordance with one or more embodiments. Also, in at least one embodiment, it is possible to use multiple, separated cylindrical systems such as the cylindrical system of FIG. 1.

As shown in FIG. 2, the system 200 functions in a similar fashion as the embodiment of FIG. 1. In contrast to system 100 which represents a single stage type system, the system 200 represents a two stage type system in that there are two sets of the components and flow paths described with reference to FIG. 1 and as described below.

Thus, in this embodiment, the system 200 comprises two evaporation zones 205 each having an inlet 210 for receiving an atomizer 215, such as a gas—(e.g., $CO_2$) assisted atomizer. The liquid fuel (and $CO_2$) are injected into the atomizers 215 (via inlets 220) and sprayed (via outlets 225) into the evaporation zones 205. In the evaporation zones 205, the fuel and $CO_2$ are vaporized using heat from (thermal) conductive plates 230. In certain embodiments, each evaporation zone 205 further comprises a bluff body 235.

With continued reference to FIG. 2, the vaporized fuel and $CO_2$ permeate through fuel filters 240 and flow into the reaction zones 245, the reaction zones 245 each being coaxially aligned with the respective evaporation zone 205.

In the periodic planar configuration of FIG. 2, the reaction zones 245 are each disposed between ITMs 250. More specifically, in this embodiment, the ITMs 250 can comprise planar membranes, where each reaction zone 245 is disposed between a first and second planar membrane. Bordering the ITMs 250 are air stream conduits 255 (air vessels) having inlets (not shown) for heated air streams. Oxygen from the heated air streams permeate through the ITMs 250 and into the reaction zones 245, resulting in a combustion reaction with the vaporized fuel and $CO_2$ stream. The combustion reaction produces heat, as well as exhausts gases comprising $CO_2$ and water vapor. At least part of the exhaust gases can be recirculated to provide partial heating to the air stream via conductive plates for better oxygen flux across the ITMs 250. Again, in this embodiment, the water vapor in the exhausted gases can be condensed leaving essentially only $CO_2$ in the exhaust gas stream, which can then be stored in order to reduce $CO_2$ emissions. As discussed below, each conduit 255 can comprise at least one planar conductive plate 265, which provides heat from the hot air/gaseous fuel stream in conduit 260 to the air stream in conduit 255. As in the first embodiment, the ITMs 250 are maintained at a temperature in the range of approximately 700° C. to approximately 900° C.

After permeation of oxygen from the air streams in the air stream conduits 255, the now oxygen-depleted air streams can also be recirculated to heat the fuel prior to entry into the evaporation zones 205 via one or more heat exchangers, for example.

The system 200 can also comprise air and gaseous fuel conduits 260, which borders the air stream conduits 255, the conduits 260 being separated from conduits 255 by (thermal) conductive walls/plates 265. The conduits 260 can each comprise an inlet (not shown) for a stream of hot air/gaseous fuel. The hot air/gaseous fuel stream can provide heat to the air stream of conduits 255 via the (thermal) conductive walls/plates 265, thereby resulting in better oxygen flux from the air stream across the ITMs 250. The system 200 can further comprises an outer wall 270 which serves as the outer barrier of the conduits 260 comprising the air/gaseous fuel streams. Certain periodic planar embodiments, such as that of FIG. 2, can provide enhanced efficiency since they avoid energy losses that can sometimes occur through outer wall 170 in a cylindrical configuration.

It should be understood from FIG. 2 that, in certain embodiments, the system can comprise several reaction zones (i.e., two or more) each coaxially aligned with its own evaporation zone, and each being disposed between planar ITMs, an air stream conduit, and/or an air plus gaseous fuel conduit. Each evaporation zone, ITM (first and second planar membranes), air stream conduit, and air/gaseous fuel conduit (with a reaction zone disposed between the planar membranes) can be thought of as collectively making up a reactor unit, and in certain embodiments, two or more reactor units can be combined, in a stacked orientation for example. For instance, FIG. 2 displays two reactor units in a stacked orientation. In one or more embodiments, for each reaction unit, the reaction zone is disposed between first and second planar membranes, and the first and second planar membranes are disposed between first and second planar plates of the air vessel (conduit 255).

It should also be appreciated that, in one or more embodiments, a manifold-type structure can be used to create multiple flow paths from a single source. For instance, in a periodic planar configuration as shown FIG. 2, there can be a single source of the liquid fuel, and a manifold structure can be used to split the liquid stream into multiple flow paths for entry into the multiple evaporation zones 205. In certain embodiments, there can also be similar manifold-like structures for other like fluid streams in the system, such as the air streams of conduits 255. Alternatively, in at least one embodiment, there can be a separate source for each liquid fuel stream for entry into each evaporation zone 205, as well as separate sources for other like fluid streams in the system 200.

Figure 3:
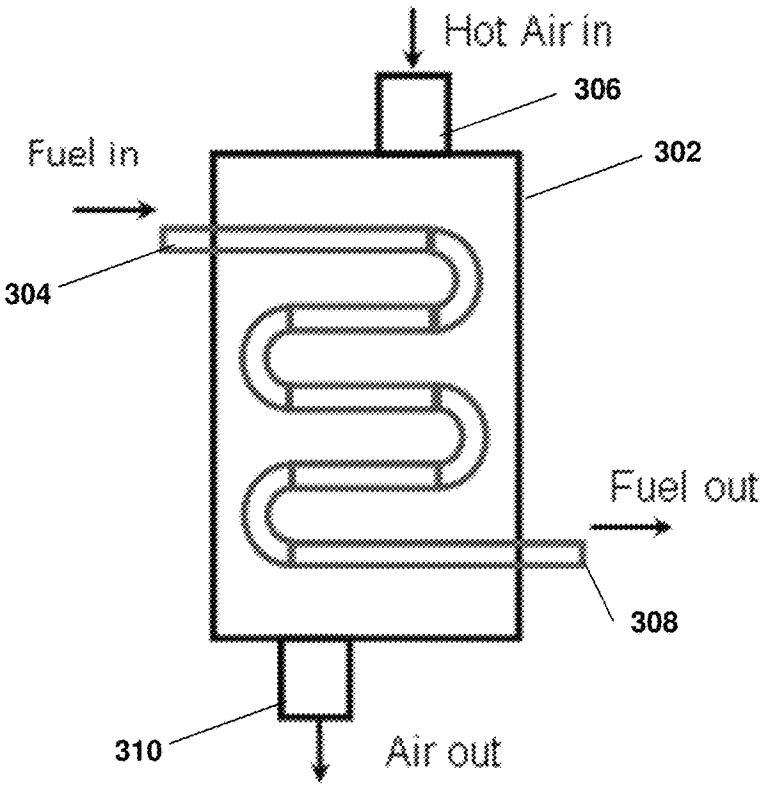
FIG. 3 is a schematic of a heat exchanger associated with the gas-assisted liquid fuel oxygen reactor in accordance with one or more embodiments.

As mentioned in the above embodiments, the energy available in the oxygen-depleted air stream in conduit 155 (or conduit 255) following permeation of oxygen through the ITMs can be utilized to heat the liquid fuel prior to entry into the evaporation chamber via one or more heat exchangers. FIG. 3 shows a heat exchanger 302 for heating of the liquid fuel prior to entry into the evaporation zone, in accordance with one or more embodiments. The heat exchanger 302 can be located upstream of the evaporation zone(s). As shown in FIG. 3, the heat exchanger 302 can have a first inlet 304 for the fuel, a second inlet 306 for the oxygen-depleted air stream, a first outlet 308 for the fuel, and a second outlet 310 for the oxygen-depleted air stream. The second inlet 306 can be connected to the air stream conduit 155 (or 255) for receiving the oxygen-depleted air, and the first outlet 308 can connect to the inlet 120 (220) of the atomizer 115 (or 215). The heat from the oxygen-depleted air stream can be transferred to the fuel stream in the heat exchanger 302 in any number of ways known to those of ordinary skill in the art. Further, the exiting oxygen depleted air is generally $N_2$ rich and can be used in industrial processes such as fertilizer industries.

As mentioned above, in accordance with one or more embodiments, the systems of the present application can be self-heating in that they can use the combustion reaction in the reaction zone to heat the ITMs to a desired temperature. Further, the energy provided by the partial recirculation of the exhaust gas stream exiting the reaction zone helps to maintain the ITM temperature. Thus, in these embodiments, the present systems are closed-loop control systems wherein the ITM temperature is maintained at a constant level in order to avoid thermal stresses in the ITM and improve thermal performance.

In one or more embodiments, each ITM can be one continuous membrane surrounding the reaction zone. In at least one implementation, the ITMs can be a series of ITM tubes. More specifically, in certain embodiments, the ITM tubes can be situated within the reaction zone and perpendicular to the sweep flow (atomized fuel and $CO_2$ entering the reaction zone) to enhance the oxygen permeation across the ITMs. In other words, in embodiments in which the sweep flow is perpendicular to the ITMs, the ITMs are considered "cross-flow" ITMs, as compared with "coaxial-flow" ITMs in which the sweep flow is parallel to the ITMs. FIGS. 4A-B show schematic drawings of the operation of a cross-flow ITM (FIG. 4A) compared with the operation of a co-axial flow ITM (FIG. 4B).

FIG. 5 shows a side view of an alternative embodiment of the gas-assisted liquid fuel oxygen reactor having cross-flow ion transport membranes. In this embodiment, the system 500 can operate in similar fashion as systems 100 and 200, and can comprise all or substantially all of the same elements as shown in the embodiments of FIGS. 1 and 2, including but not limited to an evaporation zone 505, a fuel filter 540, a reaction zone 545, ITMs 550 (in this embodiment, ITM tubes 550), conductive plates/walls (not shown), and an air plus gaseous fuel stream conduit 560.

However, unlike the embodiments above, the air stream in system 500 is fed directly into the ITM tubes 550 (as opposed to flowing along an exterior thereof), and oxygen ($O_2$) from the air stream then permeates from inside the ITM tubes 550 to the reaction zone 545 on the outside of the ITM tubes 550 as shown in FIG. 5. In other words, in this embodiment, the ITM tubes 550 are situated within the reaction zone 545, and the inside of the ITM tubes 550 function as air conduits. In the previous embodiment, the reaction zone was located internally within the ITM tube, while in this embodiment, the reaction zone is located external to the ITM tube(s).

In this embodiment, after heating of the liquid fuel and $CO_2$ in the evaporation zone 505, the vaporized fuel and $CO_2$ stream flows through the fuel filter 540 into the reaction zone 545. Here, the flow of the vaporized fuel and $CO_2$ is a "cross-flow" stream that is perpendicular to the ITM tubes 550. For example, the ITM tubes 550 can be vertically oriented from top to bottom in the reaction zone. The cross-flow of the vaporized fuel and $CO_2$ enhances the oxygen permeation from the air stream through the ITM tubes 550, thereby enhancing the efficiency of the combustion reaction in the reaction zone 545. In one or more implementations of the embodiment of FIG. 5 (i.e., cross-flow ITMs), the exhaust gas streams, oxygen-depleted air streams, and the air plus gaseous fuel streams can be recirculated in the system for heating purposes in a similar fashion as described for the embodiments of FIGS. 1 and 2, including the use of one or more heat exchangers (see FIG. 3).

While the present invention has been described above using specific embodiments, there are many variations and modifications that will be apparent to those having ordinary skill in the art. As such, the described embodiments are to be considered in all respects as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A gas-assisted liquid fuel oxygen reactor system, comprising:

a $CO_2$-assisted atomizer having an inlet adapted to receive a liquid fuel and an outlet adapted to spray atomized fuel and $CO_2$;

an evaporation zone having an inlet adapted to receive the atomized liquid fuel and $CO_2$ and having an outer wall that is formed of a thermally conductive material such that the evaporation zone is adapted to heat the atomized fuel and $CO_2$ into a vaporized form;

a reaction zone co-axially aligned with and in flow communication with the evaporation zone, wherein the reaction zone is adapted to receive a flow of the vaporized fuel and $CO_2$ from the evaporation zone;

an ion transport membrane that is coaxially aligned with the evaporation zone and defines the reaction zone;

an air vessel defined by structure that is disposed about the ion transport membrane and defines a first space between an outer surface of the ion transport membrane and an inner surface of the air vessel structure, wherein the air vessel structure is formed of a thermally conductive material and the air vessel is for receiving an air stream that flows in a counter direction relative to a flow of the vaporized fuel and $CO_2$ in the reaction zone;

a heating vessel defined by a structure that is disposed about the air vessel structure and defines a second space between an outer surface of the air vessel structure and an inner surface of the heating vessel structure, wherein the heating vessel is for receiving a heated air and gaseous fuel stream such that heat is transferred from the air and gaseous fuel stream to the first space;

wherein the ion transport membrane is adapted to provide $O_2$ permeating from the air stream and transfer the $O_2$ into the reaction zone resulting in an $O_2$-depleted air stream in the first space of the air vessel structure, and wherein the reaction zone is adapted to combust the vaporized fuel and $CO_2$ in the presence of $O_2$ to produce heat and create exhaust gases that are recirculated in the system.

2. The system of claim 1, further comprising:

a fuel filter situated between the evaporation zone and the reaction zone and adapted to remove unwanted contaminants from the vaporized fuel and $CO_2$ prior to entry of the vaporized fuel and $CO_2$ into the reaction zone.

3. The system of claim 1, further comprising:

a bluff body located within the evaporation zone and adapted to assist in the evaporation of the fuel.

4. The system of claim 1, wherein the recirculation of the exhaust gases provides energy to the system to maintain an at least substantially constant temperature at the ion transport membrane.

5. The system of claim 4, wherein a temperature at the ion transport membrane is maintained between 700° C. and 900° C.

6. The system of claim 1, further comprising:

a heat exchanger located upstream of the $CO_2$-assisted atomizer, the heat exchanger being adapted to receive the $O_2$-depleted air stream from the air vessel and the liquid fuel, and adapted to transfer heat from the $O_2$-depleted air stream to the liquid fuel prior to reception of the liquid fuel in the $CO_2$-assisted atomizer.

7. The system of claim 1, wherein the system has a cylindrical shape with the ion transport membrane, the air vessel structure and the heating vessel structure being concentric to one another, and wherein the reaction zone is located internally to the ion transport membrane.

8. The system of claim 1, wherein the ion transport membrane comprises first and second planar membranes with the reaction zone disposed there between.

9. The system of claim 8, wherein the air vessel comprises first and second planar plates with the ion transport membrane disposed there between.

10. The system of claim 9, wherein the evaporation zone, the ion transport membrane, the air vessel, and the heating vessel define a first reactor unit, and wherein the system further includes at least a second reactor unit, the second reactor unit having an identical construction as the first reactor unit, the first and second reactor units being in a stacked orientation.

* * * * *